US012622514B2

(12) United States Patent
Rodríguez Portillo

(10) Patent No.: US 12,622,514 B2
(45) Date of Patent: May 12, 2026

(54) MODULAR SYSTEM FOR BUILDING FURNITURE USING ALUMINIUM PROFILES

(71) Applicant: Constancio Rodríguez Portillo, Caceres (ES)

(72) Inventor: Constancio Rodríguez Portillo, Caceres (ES)

( * ) Notice: Subject to any disclaimer, the term of this patent is extended or adjusted under 35 U.S.C. 154(b) by 1079 days.

(21) Appl. No.: 17/765,435

(22) PCT Filed: Sep. 30, 2019

(86) PCT No.: PCT/ES2019/070652
§ 371 (c)(1),
(2) Date: Sep. 5, 2022

(87) PCT Pub. No.: WO2021/064258
PCT Pub. Date: Apr. 8, 2021

(65) Prior Publication Data

US 2023/0210258 A1 Jul. 6, 2023

(51) Int. Cl.
*A47B 47/02* (2006.01)
*A47B 87/00* (2006.01)

(52) U.S. Cl.
CPC ..... *A47B 47/021* (2013.01); *A47B 87/005* (2013.01)

(58) Field of Classification Search
CPC ..... A47B 87/005; A47B 47/021
USPC ..... 312/257.1
See application file for complete search history.

(56) References Cited

U.S. PATENT DOCUMENTS 3,203,149 A * 8/1965 Soddy ..... F16B 5/008 52/DIG. 1
3,416,793 A * 12/1968 Fox ..... A63B 5/10 482/30
3,435,575 A * 4/1969 Charles ..... A47B 96/201 52/234
3,438,164 A * 4/1969 Werner ..... A47B 47/05 52/630
3,605,363 A * 9/1971 Bard ..... E04B 2/7401 52/286
3,675,594 A * 7/1972 Kritske ..... A47B 27/04 108/2
4,087,768 A * 5/1978 Furneaux ..... H01P 7/06 312/111
5,635,885 A * 6/1997 Sipila ..... H01P 7/06 333/248
5,813,738 A * 9/1998 Cheng ..... A47B 47/00 312/265.5

(Continued)

*Primary Examiner* — Daniel J Troy
*Assistant Examiner* — Timothy M Ayres
(74) *Attorney, Agent, or Firm* — John Alumit

(57) ABSTRACT

Constituted from aluminum profiles object of the present invention is constituted from a set of extruded aluminum profiles, more or less long and rectangular, which make up the walls, the base and the ceiling, forming in itself the structure of the furniture, and that present at their ends double terminations in the form of a hitch that allow linking and fixing each other varying the dimension of the bottom of the furniture. They also include a slot to house a silicone rubber, tubular reinforcements to improve grip by screws, a space to fix metal plates that will make the bottom, and an increase in interior thickness at certain points to improve grip by fixing screws for hinges, shelf supports, or any other accessory.

7 Claims, 8 Drawing Sheets

(56) References Cited

U.S. PATENT DOCUMENTS

| | | | | |
|---|---|---|---|---|
| 6,027,192 | A * | 2/2000 | Irace | A47B 96/021 312/263 |
| 7,596,924 | B2 * | 10/2009 | Sakae | E04C 2/36 52/793.1 |
| 7,765,942 | B2 * | 8/2010 | Choi | A47B 47/04 108/193 |
| 10,215,209 | B2 * | 2/2019 | Lai | F16B 12/2036 |
| 10,264,882 | B1 * | 4/2019 | Lai | A47B 96/04 |
| 11,898,592 | B1 * | 2/2024 | Mata | F16B 5/0012 |

* cited by examiner

MODULAR SYSTEM FOR BUILDING FURNITURE USING ALUMINIUM PROFILES

OBJECT OF THE INVENTION

The present invention relates to a system of modular parts of aluminum profiles that allow to configure and build a multitude of possibilities and combinations of furniture.

One of the main problems in the kitchen, bathrooms and other places in a house when designing and configuring furniture is dealing with the columns and pillars that complicates the uniformity of furniture backgrounds, cabinets and shelves.

The system that describes the present invention proposes a solution to the disparity of funds necessary to match the front face of contiguous furniture to be able to combine in an infinite number of ways through the different profiles that compose it.

On the other hand, it does not need machinery to cut bottoms or assembly specialists, since the user of the house can easily assemble it by assembling the aluminum profiles that make up the system. In the same way, the furniture could be dismantled and its dimensions and characteristics modified by combining the profiles in a different way, adding or removing pieces.

Other of the many advantages of this invention would be the following:

- Being aluminum, the durability of the material makes it a piece of furniture for life, it does not rust, does not swell, is not affected by humidity or rain, in addition to being a very clean and hygienic material. It is also a material that does not ignite unlike wood, so it is an important factor to reduce the risk of fire in kitchens.
- It does not have edges like chipboard, it does not need to be painted or varnished.
- Combining some profiles or others, more profiles or less, different measures and furniture backgrounds are achieved through a system of tabs very easy to assemble and disassemble.
- The profiles contain reinforced areas to facilitate the installation of any type of accessory such as hinges, shelf supports, etc.
- The strength of the profiles allows to assemble furniture of dimensions such that conventional furniture would yield or curve.
- The system is made in such a way that for transport it can occupy a very small space, as it does not have the need to go practically assembled by the manufacturer or distributor.

The industrial application of this invention is within the manufacture and assembly of furniture, and more specifically manufacture and assembly of furniture from a modular system of aluminum profiles.

BACKGROUND OF THE INVENTION

Although no invention identical to the one described has been found, we expose below the documents found that reflect the state of the art related to it.

Thus, document ES2531617T3 refers to a multifunctional modular counter/display, consisting of at least: —a metal structure consisting of at least three metal frames that form the front and side uprights of said counter/display; consisting of at least: —a set of front and side walls attached respectively to the front frame and a side frame: a removable presentation board fixed to said metal structure at the top of each of the three metal frames. Being the front and side walls and the removable presentation board fixed to the metal frames by means of a non-permanent adhesive band. The aforementioned invention refers to a counter/display while the main invention refers to a modular system of pieces to create furniture and shelves.

ES2252094T3 describes a constructive element with at least one joining surface for an assembly with other constructive elements, being arranged at least in sections a matrix on at least one of the joining surfaces, the matrix being solidified at least partially and composed of an adhesive, resin or wax, being arranged in a distributed way a plurality of capsules in the matrix, containing the capsules a substance of an adhesive system by reaction and releasing by external action at least a part of the capsules, at least partially, the substance contained in them, characterized by the fact that the matrix presents at least two layers of matrix, because at least one layer of matrix presents the capsules and because at least another layer of matrix does not present any capsule. The system of union between constructive elements of the aforementioned invention is nothing like that proposed by the main invention, apart from comprising a multitude of different elements to be assembled, while the main invention presents a set of very similar pieces between them for the composition of furniture and shelves.

ES2014903A6 describes improvements in the assembly system of auxiliary furniture, consisting of platforms, horizontal and tubular support modules, that the tubular modules consist of a body of polygonal section, hollow, at whose ends they present, conveniently anchored two internal bushings, equipped with a filleted axial cavity, the upper bush being equipped with an outstanding stem filleted, so that when manually rotating the tubular module, using the module itself as the drive handle, the filleted stem is inserted and threaded into the filleted and calibrated axial cavity of the female bush at the lower end of the module immediately above, sandwiching between both modules, properly aligned, one of the sleeves, of polygonal section, equipped with calibrated axial pitch, that for mounting purposes present in their contour the horizontal platforms. The assembly system described uses a totally different assembly system than the one proposed by the main invention, while one comprises horizontal platforms and tubular modules, another uses aluminum profiles assembled with each other.

ES2172358B1 and ES2263329B1, describes a system of construction of aluminum sheet furniture without structure and improvements of the same respectively, consisting of the industrialized construction of aluminum furniture by which the sheets are cut foreseeing a perimeter area destined to be boxed and folded. It is drawn, the perforations that will house the means of fastening of the shelves or the means of union of the faces are drilled, the vertical folds are folded at right angles, the lateral faces are vertically assembled with the back face and the face of simple fold that forms the base to the lateral and rear faces. The upper span of the front is closed by a separator. On the four upper angles are placed four reinforcement brackets. On the outside of the base, two means of reinforcement consisting of horizontal square profiles are mounted to the rear face that support the legs, the conventional door is mounted fixing the hinges to internal counterforces of the same and the sides equal to those are attached to the lateral faces but with the folds inwards. The system described is based on the manufacture of cut and folded aluminum sheets that in turn make faces and structure of furniture, while the main invention comprises a set of profiles assembled with each other.

Conclusions: As can be seen from the research carried out, none of the documents found solves the problems posed as the proposed invention does.

DESCRIPTION OF THE INVENTION

The modular system of construction of furniture from aluminum profiles object of the present invention is constituted from a set of extruded aluminum profiles, more or less long and rectangular, which make up the walls, the base and the ceiling, forming in itself the structure of the furniture, and that present at their ends double finishes in the form of a hitch that allow linking and fixing each other varying the dimension of the bottom of the furniture.

Some profiles have these terminations at only one end and others at both, with some main pieces with a flat end (facing the user), where it has a groove to house a silicone rubber, and another end with the double hitch finish (facing the bottom or wall), and some secondary pieces that have an end with the finish that fits into the double hitch of the piece Main and at the other end have exactly the same double hitch shape of the main piece to be able to connect new secondary pieces until reaching the desired background dimension. These secondary pieces can be unique or be arranged in two or more lengths, depending on the need to connect more or less pieces until reaching the desired furniture bottom dimension.

A third type of profile, without ends with double hitch finish serves to join or close horizontally the structure of the furniture that would form its side walls based on primary and secondary profiles, when it is necessary that the upper or lower face of the furniture is hollow (for example to place sink, ceramic hob, etc.).

The union between profiles that form the walls with the profiles that make the base or ceiling, or the union between profiles that form the walls with the so-called third type profiles is made by screws, where these profiles have, inside the rectangle that form them, circular tubular reinforcements of non-complete arch and, on the outside of one of its faces, a mark aligned with the axis of these tubular reinforcements to give consistency to the union of 90 degrees. A drill is drilled on the outside of the furniture, and the screw crosses the inner face of the profile and threads on the tubular reinforcement of the other piece.

The union by means of a double coupling finish to link some profiles with others and increase or decrease the bottom of the furniture consists, at one end, in the continuation of the lateral faces of the profile, one more than the other, and both finished in loops facing inwards, and comprising the other end where it also couples an extension of their faces, again one more than the other, and both finished in loops but facing outwards, having modified the prolongation of the faces of the profile in two angles of 45 degrees so that they are aligned internally with the loops of the hitch to be coupled.

The bottom of the furniture can be covered by aluminum plate, which is anchored to the profiles inserted by the space formed by the clamp that is shorter of the two along with an extension perpendicular to the extension of the profile that contains the facing loop.

In cases where the so-called third type profile is used and you want to cover the bottom with an aluminum plate, this profile includes in one of its corners a hole where the plate fits.

Both the main pieces and the so-called third type all have a groove that runs through their faces that give the view to insert a silicone rubber to isolate the interior of the furniture when there are doors.

All the main profiles include reinforcement in the form of an increase in interior thickness at certain points to improve grip by fixing screws for hinges, shelf supports, or any other accessory that a kitchen or bathroom cabinet may carry in particular.

BRIEF DESCRIPTION OF THE DRAWINGS

For a better understanding of the present description are accompanied by drawings that represent a preferential realization of the present invention.

Figure 1:
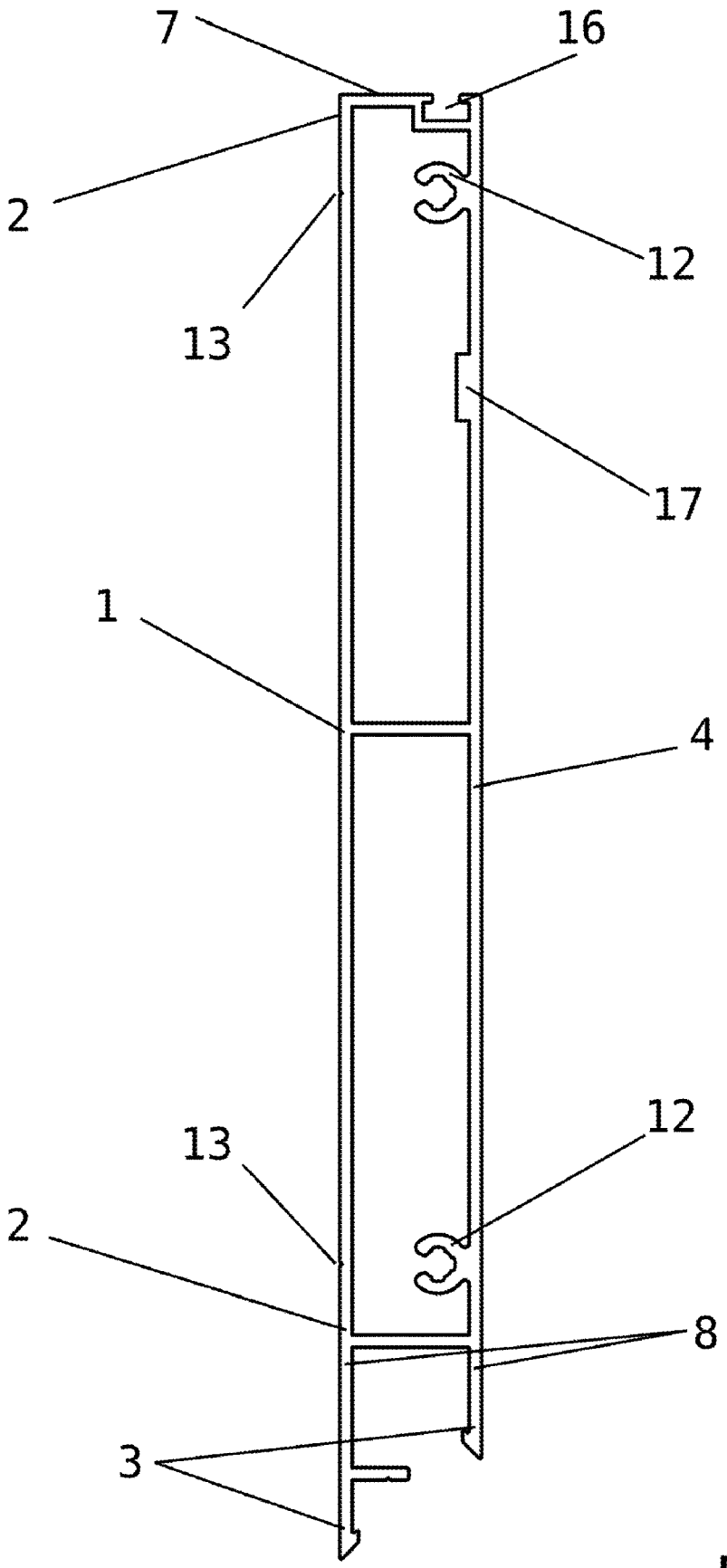
FIG. 1: Main Type Profile View
Figure 2:
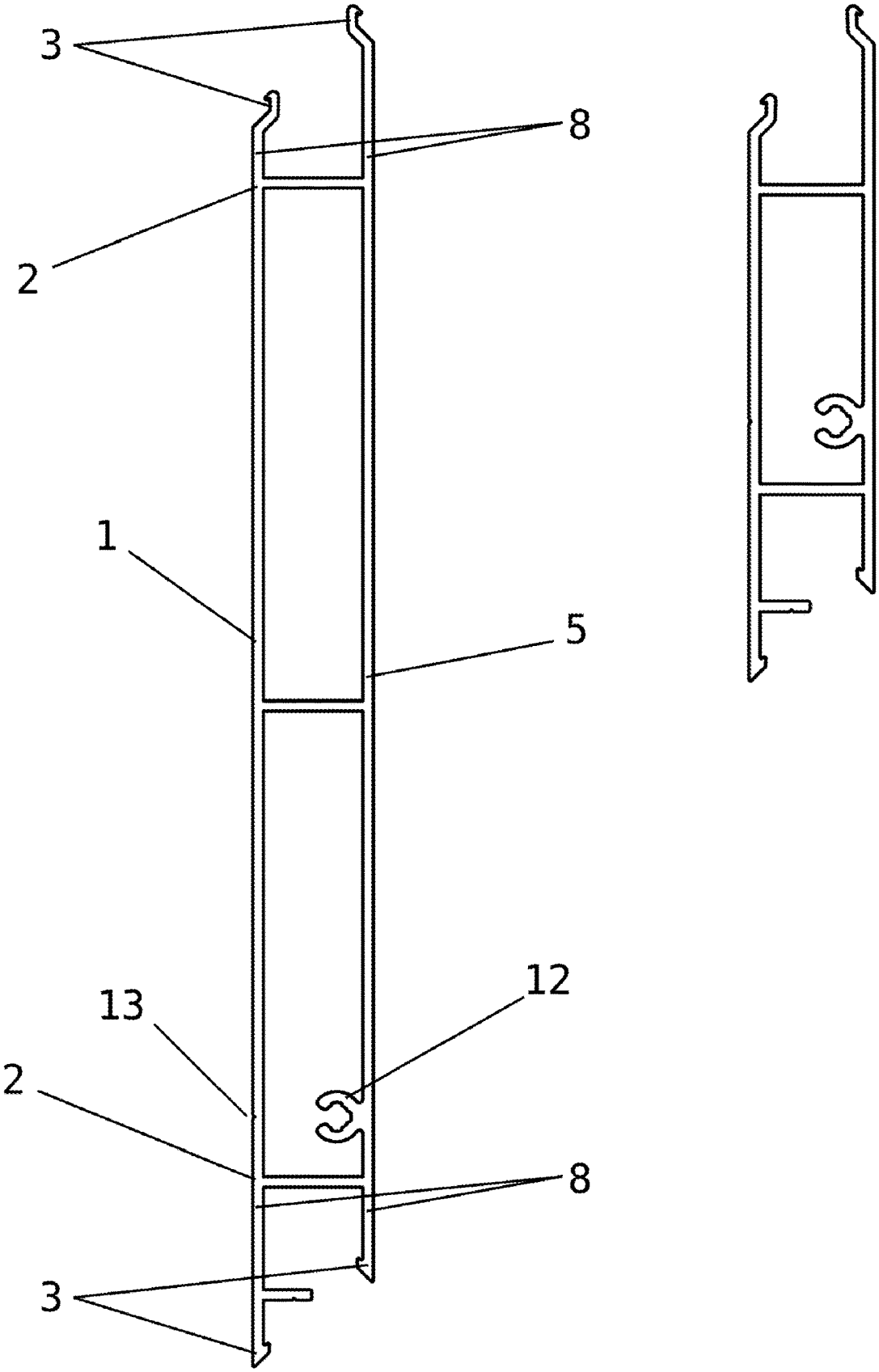
FIG. 2: View of the secondary type profile (one or two sizes)
Figure 3:
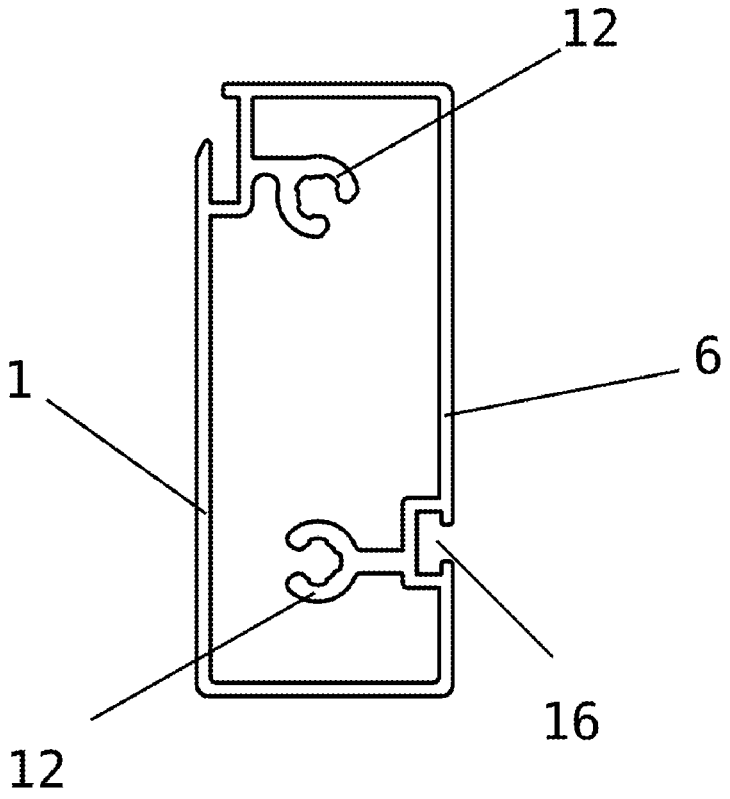
FIG. 3: Third Type Profile View
Figure 4:
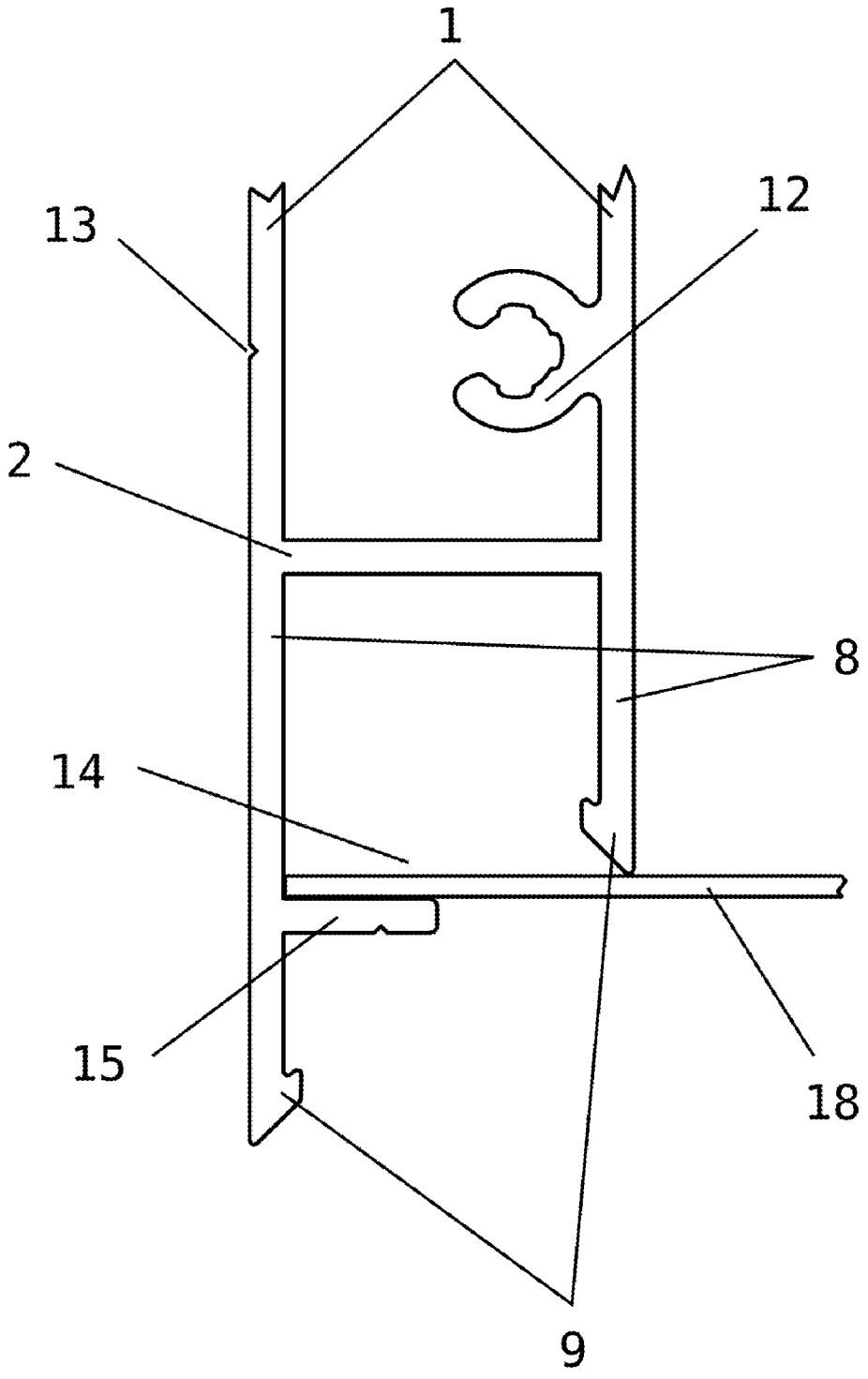
FIG. 4: Detailed view of the end in the background (primary and/or secondary pieces)
Figure 5:
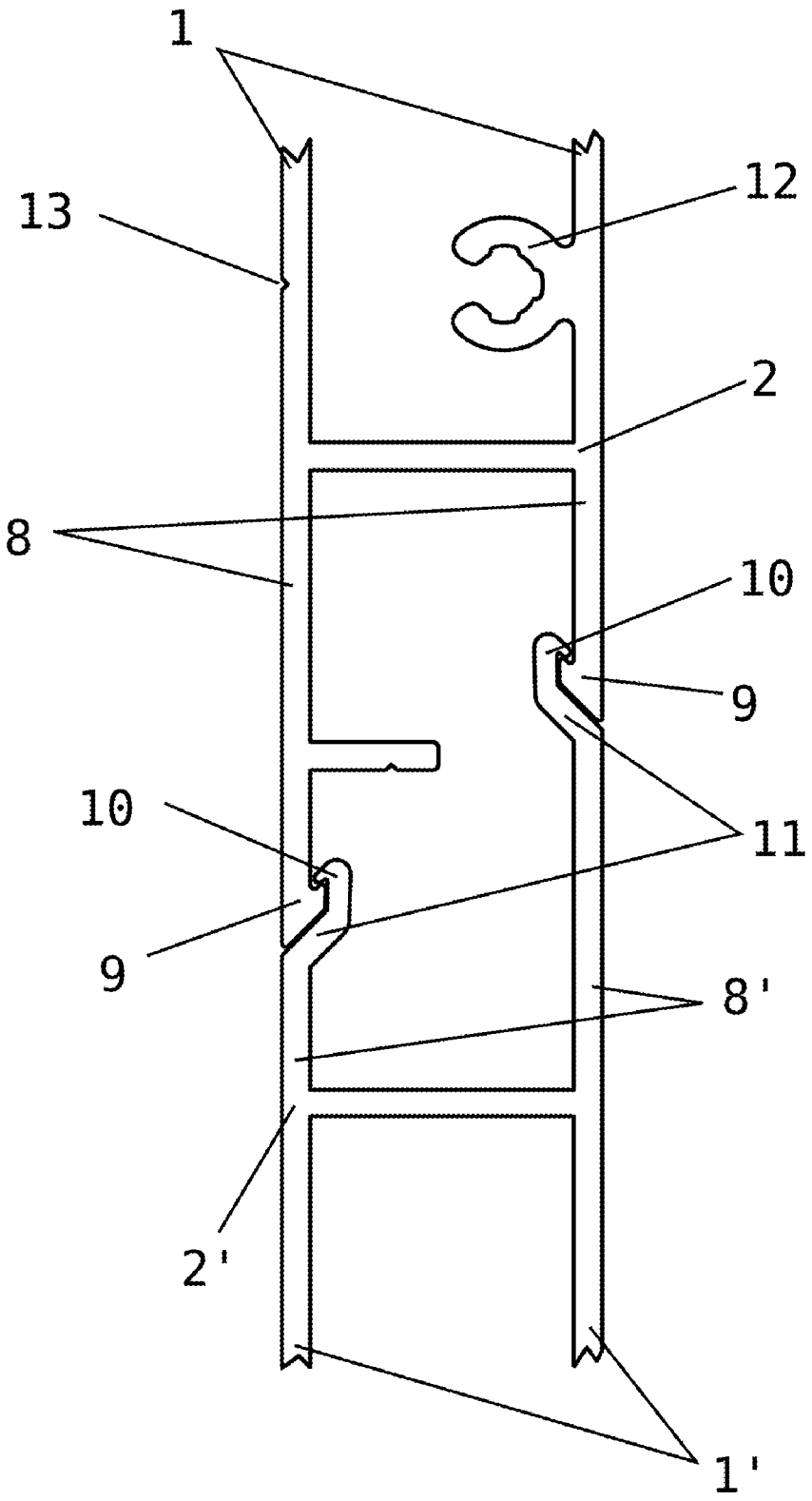
FIG. 5: Detailed view of the type of hitch between clips
Figure 6:
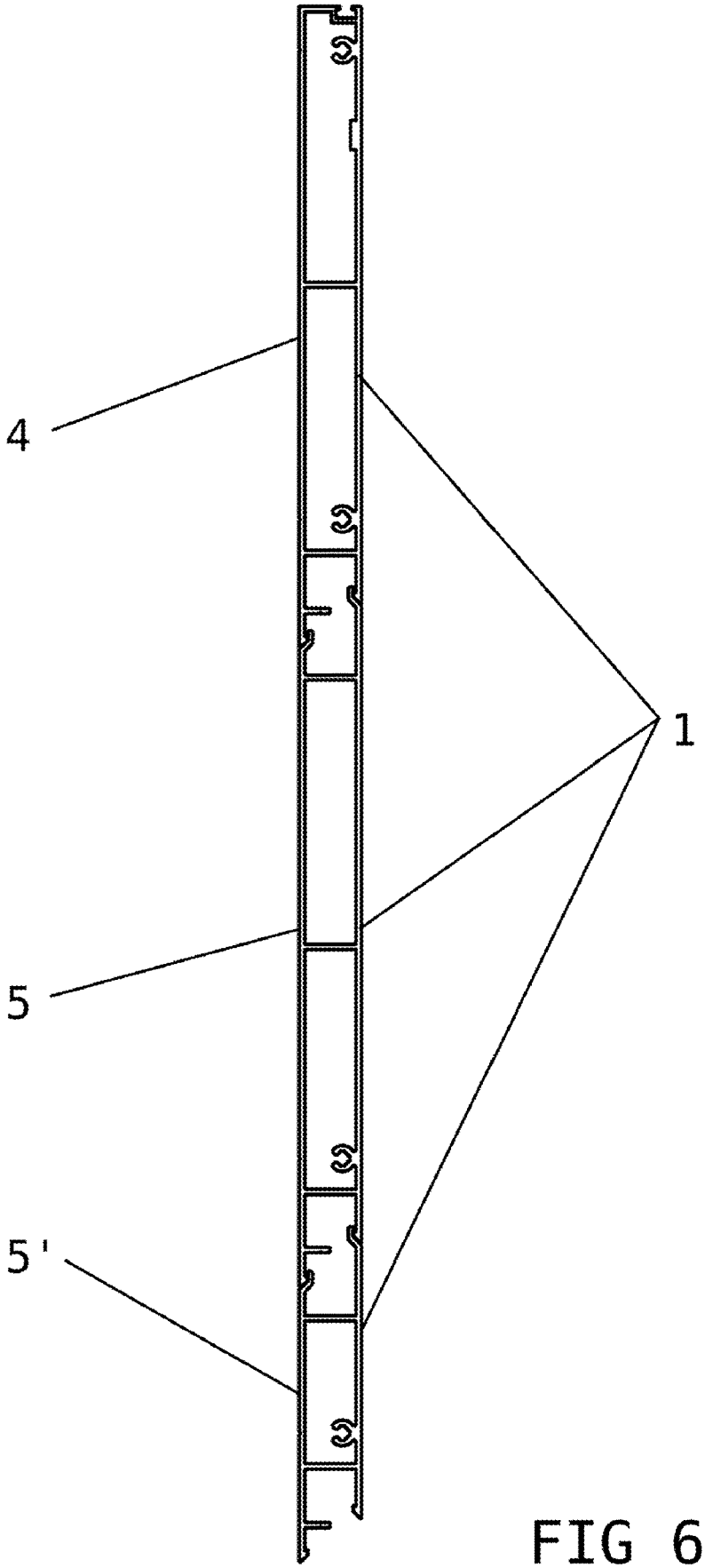
FIG. 6: View of multiple profiles coupled by clips
Figure 7:
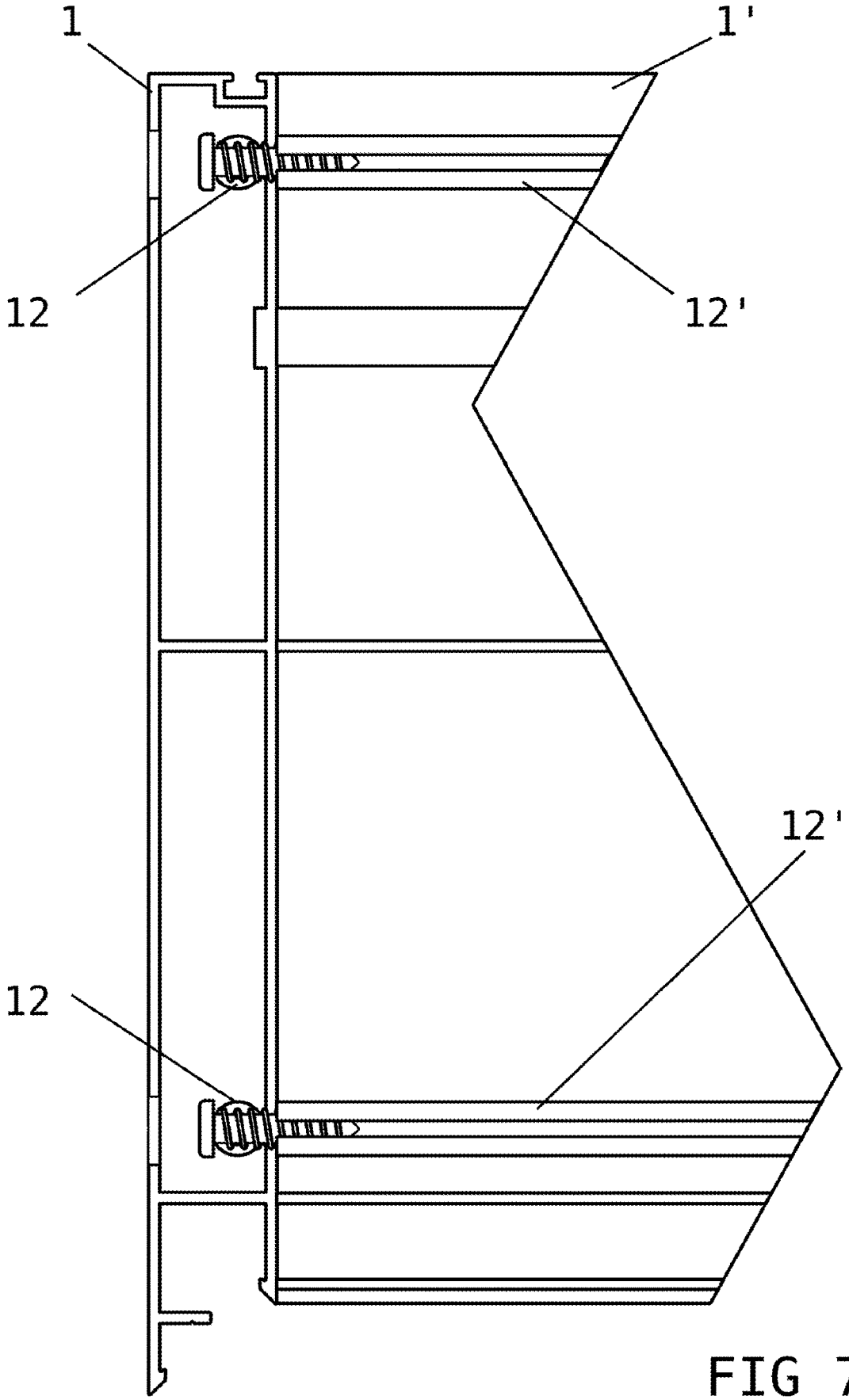
FIG. 7: Detailed view of joining profiles that form 90 degrees
Figure 8:
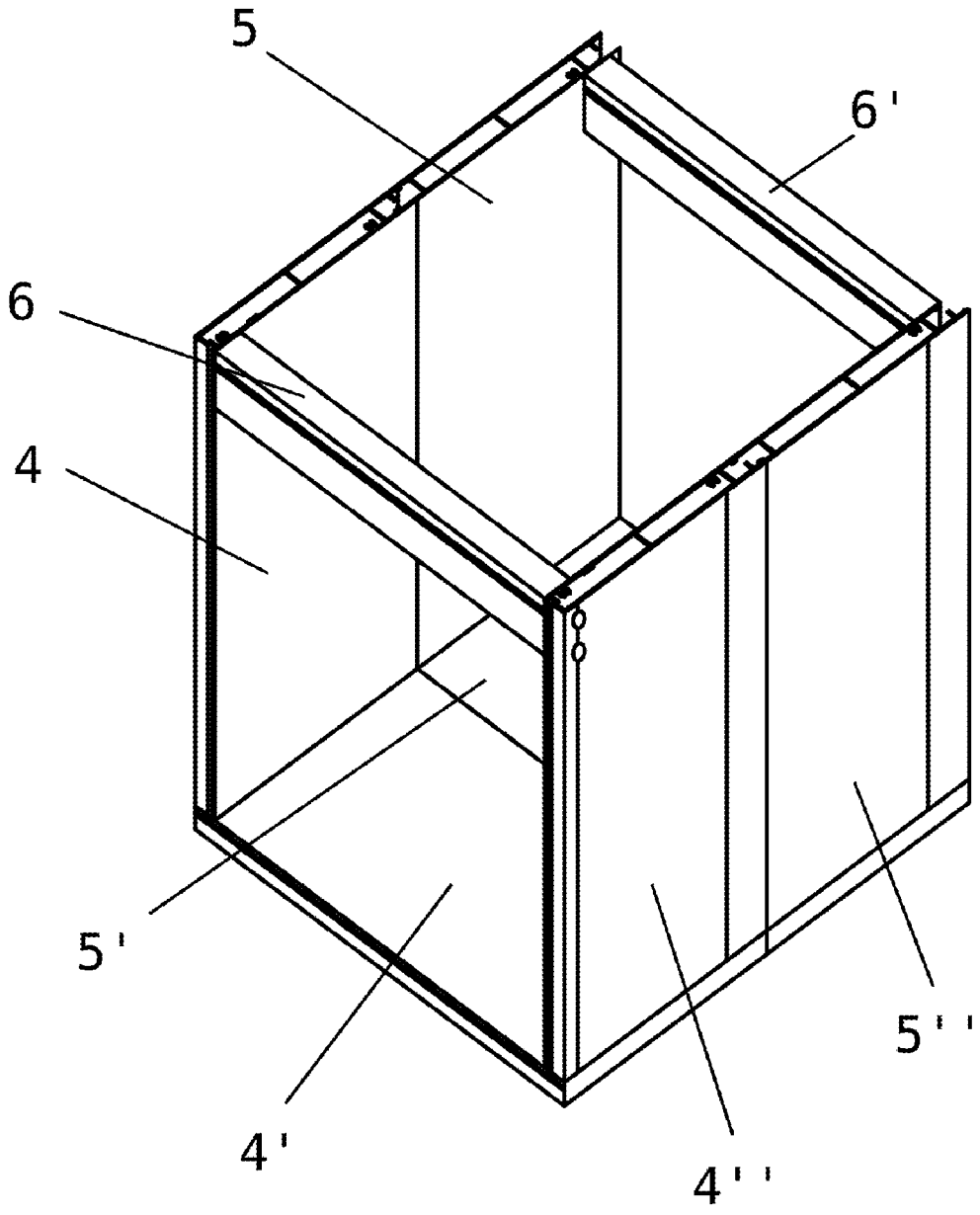
FIG. 8: Perspective view of an example of furniture built from the modular system object of the present invention The numerical references that appear in these figures correspond to the following constituent elements of the invention.

1. Extruded aluminium profile
2. Profile endpoint
3. Double hitch
4. Main type profile
5. Secondary type profile
6. Third type profile
7. Extreme with flat face
8. Prolongation of lateral faces
9. Facing inwards
10. Loops facing outwards
11. Modified 45 degree double angle
12. Tubular reinforcement
13. Aligned brand
14. Space for bottom sheet
15. Perpendicular extension
16. Silicone slot
17. Thicker reinforcement
18. Metal plate

DESCRIPTION OF A PREFERRED REALIZATION

A preferential realization of the modular system of furniture construction from aluminum profiles object of the present invention, with allusion to numerical references, can be based on a set of extruded aluminum profiles (1), more or less long and rectangular, which make up the walls, the base and the ceiling, forming in itself the structure of the furniture, and that they have at their ends (2) double hitch finishes (3) that allow linking and fixing each other by varying the dimension of the bottom of the furniture.

According to the number of ends (2) with double coupling (3) to link some profiles with others, these profiles can be classified into main (4), secondary (5) and tertiary or third type (6). The main ones (4) have a flat face (7) which is the one that is visible and an end (2) with double hitch (3) that faces the wall or bottom; secondary (5) have snags (3) at both ends (2); and those of the third type (6) have no snags.

The union by means of a double coupling termination (3) to link some profiles with others and increase or decrease the bottom of the furniture consists, at one end (2), in the continuation of the lateral faces of the profile (8), one more than the other, and both finished in loops facing inwards (9), and comprising the other end (2) where it also couples an extension of their faces, again one more than the other, and both finished in loops but facing outwards (10), having modified the prolongation of the faces of the profile at two angles of 45 degrees (11) so that they are aligned internally with the loops of the hitch to be coupled.

The union between profiles that form the walls with the profiles that make the base or ceiling, or the union between profiles that form the walls with the so-called third type profiles is made by screws, where these profiles have, inside the rectangle that form them, circular tubular reinforcements of non-complete arch (12) and, on the outside of one of its faces, a mark aligned (13) with the axis of these tubular reinforcements (12) to give consistency to the union of 90 degrees. The joint itself is achieved by practicing a small drill on the outer face of the furniture, and the screw crosses the inner face of the profile and threads on the tubular reinforcement (12) of the other piece.

The bottom of the furniture is covered by aluminum plate (18), which is anchored to the profiles inserted by the space (14) that form the loop that is shorter of the two along with an extension perpendicular (15) to the extension of the profile that contains the facing clamp.

Both the main pieces (4) and the so-called third type (6) all have a groove (16) that runs along their faces (7) that give the view to insert a silicone rubber to isolate the interior of the furniture when there are doors.

All the main profiles include a reinforcement (17) in the form of an increase in interior thickness close to the flat face (7) that is visible, to improve the grip by fixing screws for hinges, shelf supports, or any other accessory that can carry a kitchen or bathroom cabinet in particular.

In a different embodiment there may be different secondary parts (5) in which their only difference is the length from one end of the profile to the other.

The invention claimed is:

1. A modular system of furniture construction from aluminum profiles, comprised of a set of extruded aluminum profiles (1) which each are rectangular in shape and combine to make up the walls, the base and the ceiling to form the structure of the furniture, characterized in that each profile ends (2) includes double hitch finishes (3) that allow linking and fixing each other varying the dimension of the bottom of the furniture, the double hitch finishes form a double coupling, at one end (2), in the continuation of the lateral faces of the profile (8), one lateral face is about 12 millimeters longer than the other lateral face, and both finished in loops facing inwards (9), and comprising the other end (2) where it also couples an extension of their faces, about 12 millimeters one more than the other, and both finished in loops facing outwards (10), the loops that are facing outward are slightly narrower than the width of the profile, so that they are aligned internally with the loops of the hitch to be coupled, due to a double angle of 45 degrees (11) just before reaching these loops that look out (10).

2. The modular system of furniture construction from aluminum profiles, according to claim 1, characterized because the pieces that form the structure of the furniture can be classified according to the number of ends (2) with double hitch (3) that comprise to link some profiles with others, comprising main pieces (4), which has a flat face (7) that is the one that is visible and an end (2) with double hitch (3) that looks towards the wall or background; secondary pieces (5), which have snags (3) at both ends (2); and pieces of the third type (6), which do not have snags and serve to join or close horizontally the structure of the furniture that would form its side walls based on primary (4) and secondary (5) profiles, when it is necessary that the upper or lower face of the furniture is hollow.

3. The modular system of furniture construction from aluminum profiles, according to claim 1, characterized because the union between profiles that form the walls with the profiles that make the base or ceiling, or the union between profiles that form the walls with third type profiles is made by screws, where these profiles comprise, on the inside of the rectangle that form the profiles, tubular reinforcements (12) circulars whose circle arch does not close completely and, on the outside of one of its faces, a mark aligned (13) with the axis of said tubular reinforcements (12) to give consistency to the union being 90 degrees, the union is achieved by a small drill on the outer face of the furniture, and the screw crosses the inner face of the profile and threads on the tubular reinforcement (12) of the other piece.

4. The modular system of furniture construction from aluminum profiles, according to claim 1, characterized because the profiles comprise a space (14) that form a chair along with an extension perpendicular (15) to the extension of the profile that creates a facing clamp to place a metal plate (18) that would make the background of the furniture.

5. The modular system of furniture construction from aluminum profiles, according to claim 2, characterized by the fact that both the main pieces (4) and the third type (6) comprise a groove (16) that runs along its face (7) that is visible to insert a silicone rubber to isolate the interior of the furniture when there are doors.

6. The modular system of furniture construction from aluminum profiles, according to claim 1, characterized because all the main profiles comprise a reinforcement (17) in the form of an increase in interior thickness to improve grip by fixing screws for hinges, shelf supports, or any other accessory.

7. The modular system of furniture construction from aluminum profiles, according to claim 1, characterized by two different sizes of secondary pieces (5) in which the only difference is the length between the double snags (3) from one end (2) to the other of the profile.

* * * * *